United States Patent [19]

Kemp et al.

[11] Patent Number: 4,501,336

[45] Date of Patent: Feb. 26, 1985

[54] METHOD AND APPARATUS OF A SELF-ALIGNING SLEEVE FOR THE CORRECTION OF THE DIRECTION OF DEVIATED BOREHOLES

[76] Inventors: Billy W. Kemp, P.O. Box 2102, New Iberia, La. 70560; William S. Brashear, P.O. Box 156, Moody, Tex. 76957

[21] Appl. No.: 384,778

[22] Filed: Jun. 3, 1982

[51] Int. Cl.[3] ..... E21B 44/00

[52] U.S. Cl. ..... 175/61

[58] Field of Search ..... 175/61, 73, 76, 320, 175/325

[56] References Cited

U.S. PATENT DOCUMENTS

| | | | |
|---|---|---|---|
| 2,712,434 | 7/1955 | Giles et al. | 175/73 |
| 3,156,310 | 11/1964 | Frisby | 175/76 |
| 4,185,204 | 1/1980 | Nixon | 175/76 |

OTHER PUBLICATIONS

"Prilco develops tool to steer bits", *The Oil and Gas Journal,* Sep. 28, 1964, p. 49.

*Primary Examiner*—Ernest R. Purser
*Assistant Examiner*—Timothy David Hovis
*Attorney, Agent, or Firm*—Bode & Smith, P.C.

[57] ABSTRACT

A method and apparatus for correcting the direction of a deviated borehole having a self-aligning sleeve slideable over flexible members of the drill string assembly, which is non-rotating and substantially the same length as a flexible member of the drill string assembly, having two elliptical protrusions. There further is included a first protrusion means for centering and stabilizing the tool in the borehole. Also, a second pad-like protrusion means is included for guiding the drill bit and drill string assembly in the desired direction.

9 Claims, 7 Drawing Figures

METHOD AND APPARATUS OF A SELF-ALIGNING SLEEVE FOR THE CORRECTION OF THE DIRECTION OF DEVIATED BOREHOLES

BACKGROUND OF THE INVENTION

1. Field of the Invention

The present invention relates to a method and apparatus for correcting the direction of a deviated borehole that has gone off course during a normal drilling operation. The present invention provides more particularly a self-aligning sleeve with two elliptically-shaped protrusion means for guiding a drill bit in the correct direction after the borehole has deviated from the intended course.

2. General Background

The direction a borehole takes during drilling is influenced by various factors which cause the borehole to deviate from its intended course. These factors include the configuration of the formation through which the borehole is being drilled, the angle of the drill bit and the weight applied to the drill string assembly during the drilling process.

Many devices have been patented and used commercially either to limit the deviation of the borehole or to correct the direction of the deviated borehole. Drill collars and stabilizers are examples of recognized methods of limiting the deviation of a borehole.

Correcting deviation in a borehole may be accomplished by the following devices and techniques which guide and drill pipe and drill bit into the desired direction: a whip stock, a mud motor, a bent sub placed above a downhole motor that is used to drive the drill bit, stabilizers attached to the lower drill string member near the drill bit, and eccentric sleeves.

In U.S. Pat. No. 4,270,619 issued to Base entitled "Downhole Stabilizing Tool with Actuator Assembly and Method for Using Same" teaches the use of a tool that is an independent member that connects into a drill string assembly. The tool has stabilization pads that move radially for selected engagement with the borehole.

U.S. Pat. No. 4,220,213 issued to Hamilton entitled "Method and Apparatus for Self Orienting a Drtill String While Drilling a Well Bore" teaches an eccentric sleeve with a projection means that extends radially beyond the diameter of the drill bit in order to develop as much rigidity as possible in the lower drill string assembly near the drill bit.

U.S. Pat. No. 4,076,084 issued to Tighe entitled "Oriented Drilling Tool" is a sleeve composed of three tubular members inserted into one another. The innermost member is drilled offcenter to make an eccentric sleeve.

U.S. Pat. No. 4,108,256 issued to Moore entitled "Sliding Stabilizer Assembly" teaches a sliding sleeve with helical vanes attached to the outer surface for use in drilling horizontal boreholes.

Amongst other things the aforementioned patents differ from the preferred embodiment of the present invention in three aspects. First, the patents teach an apparatus that rotates coaxially with the drill string assembly, while the present invention remains stationary as the drill string assembly rotates through its hollow center.

Second, the patented tools are designed to remain on the drill string assembly during normal drilling operations, while the preferred embodiment of the present invention is connected to the drill string assembly on an as needed basis. Thus, since the present invention is not in continuous use it is not as susceptible to damage and wear as the patented invention, thus prolonging the life of the self-aligning sleeve and saving rig time that would have to be spent in replacing damaged tools.

Third, the patented tools are designed to connect to the drill string assembly near or adjacent to the drill bit. The additional weight on the drill bit created by the proximity of the patented tools to the drill bit causes the bit to deflect from its intended course.

GENERAL DISCUSSION OF THE PRESENT INVENTION

The preferred embodiment of the method and apparatus of the present invention solves problems encountered in the present state of the art in a simple and straight-forward manner. What is provided is a self-aligning non-rotating sleeve that is slidable over flexible drill string members. The self-aligning sleeve is provided with two elliptically-shaped protrusions. The first protrusion is means for centering and stabilizing the sleeve in the borehole. The second protrusion, thicker than the first, is means for determining the direction of the drill bit. Below the sleeve at the lower end of the drill string assembly there is provided a flexible drill string member, a near-bit stabilizer and a drill bit. As weight is placed on the drill string assembly, the flexible drill string member below the self-aligning sleeve bends in a direction opposite from the position of the second protrusion means. The blades of the near-bit stabilizer communicate with the walls of the borehole and the stabilizer acts as a fulcrum guiding the drill bit in the direction of the second protrusion.

The object of this invention is to provide a new and improved method and apparatus for the correction of the direction of deviated boreholes.

A further object of this invention is to provide a method and apparatus for the correction of the direction of deviated boreholes that can be used while the normal drill string assembly is rotating.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
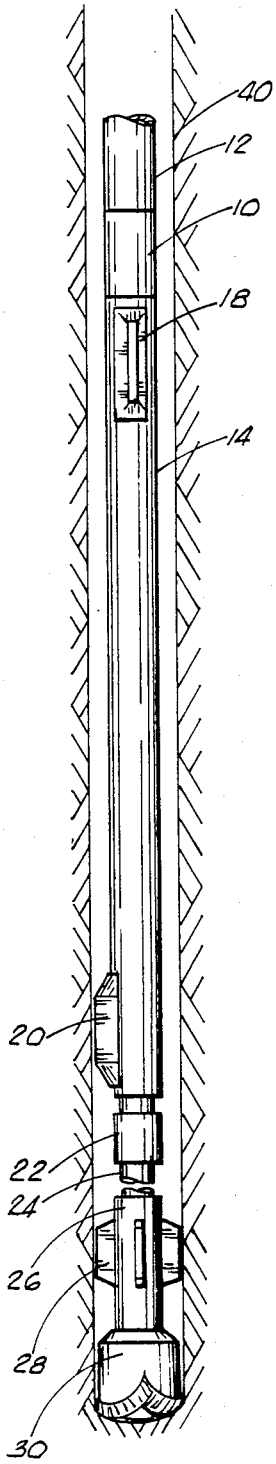
FIG. 1 is a side view of a section of a drill string assembly illustrating the preferred embodiment of the present apparatus and its spatial relationship to the drill string members such as drill collar or drill pipe, near bit stabilizer and drill bit in a straight hole.

FIGS. 1–3 and FIG. 7 illustrate best the preferred embodiment of the present invention generally designated by the numeral 10, FIGS. 1–3 and 7.

Self-aligning sleeve 10 is a tubular structure 14 with two elliptically-shaped protrusion means 18 and 20. First protrusion means 18 has an exterior surface that longitudinally engages with the borehole walls 40. First protrusion means 18 centers and stabilizes the sleeve 10 in borehole 40.

Figure 2:
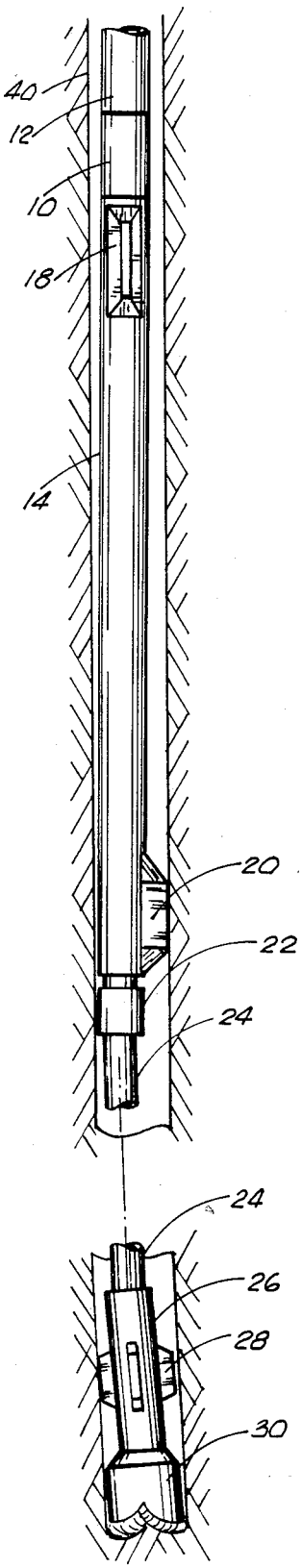
FIG. 2 is a side view of the preferred embodiment of the present apparatus illustrating the alignment of the self-aligning sleeve in a deviated borehole necessitating correction to the left.
Figure 3:
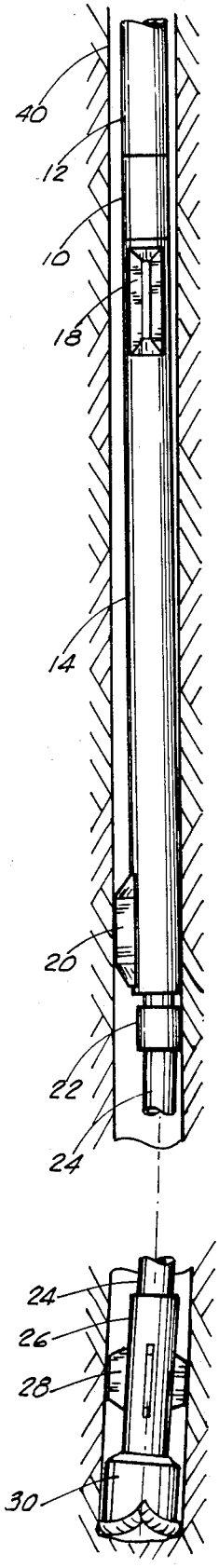
FIG. 3 is a side view of the preferred embodiment of the present apparatus illustrating the alignment of the self-aligning sleeve in a deviated borehole necessitating correction to the right.
Figure 5:
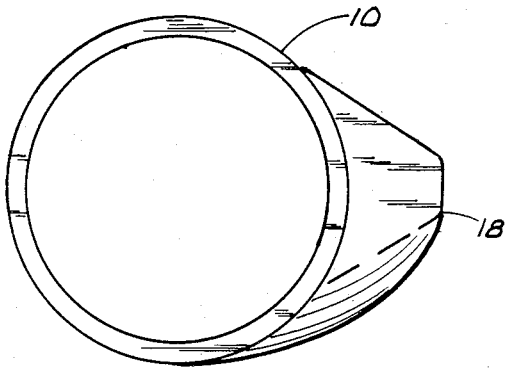
FIG. 5 is an elevational view on line A-A of FIG. 7 illustrating the first elliptically-shaped protrusion means for centering and stabilizing the present apparatus in the borehole.
Figure 6:
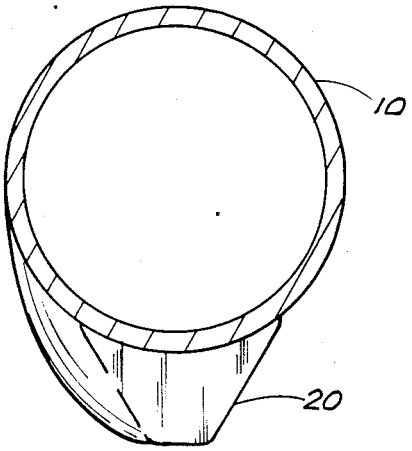
FIG. 6 is an elevational view on line B-B of FIG. 7 illustrating the second elliptically-shaped protrusion means for directing the drill bit in the correction direction.
Figure 7:
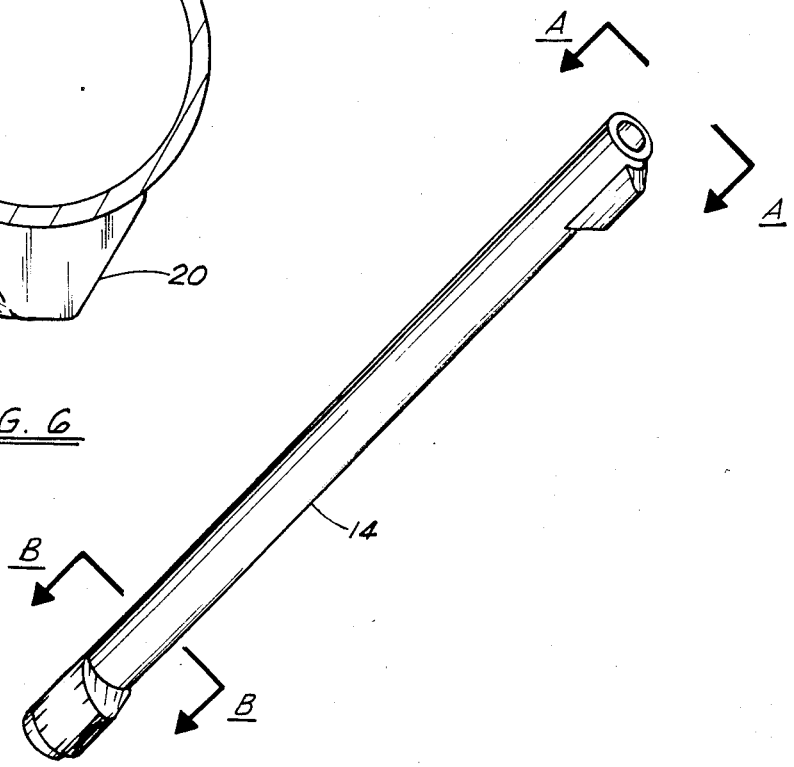
FIG. 7 is a side elevational view illustrating the relative positions of the first elliptically-shaped protrusion to the second elliptically-shaped protrusion.

Second protrusion means 20 is offset circumferentially from first protrusion means 18. Second protrusion means 20 has an exterior surface that likewise longitudinally engages with the borehole wall 40. Second protrusion means 20 has a greater exterior circumference than does first protrusion means 18, thereby providing second protrusion means 20 with a greater exterior circumference than does first protrusion means 18, thereby providing second protrusion means 20 with a greater surface area with which to communicate with borehole wall 40, as is illustrated in FIGS. 5–7. The preferred embodiment of self-aligning sleeve 10 comprises two different sleeves, one having a second protrusion means 20 oriented to the right, as illustrated in FIG. 2, and one having a second protrusion means 20 oriented to the left as seen in FIG. 3.

Figure 4:
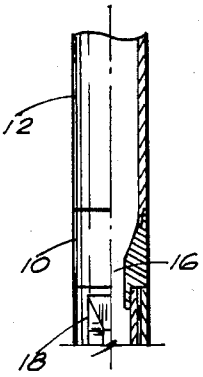
FIG. 4 is a side view, partially in section, illustrating the first elliptical protrusion means for centering and stabilizing the present apparatus in the borehole, as well as illustrating flexible drill string members over which the present apparatus is slipped.

Flexible drill string member 16, FIG. 4 is inserted into the hollow center of said self-aligning sleeve 10. Flexible drill string member 16 is connected to an upper drill string member 12 of the same outer diameter as that of self-aligning sleeve 10 thereby preventing self-aligning sleeve 10 from moving upward during drilling operations. Flexible drill string member 16 rotates during drilling operations, however self-aligning sleeve 10 remains stationary.

Retaining means 22 is connected to the lower end of flexible drill string member 16. Retaining means 22 has an outer diameter of sufficient size to prevent self-aligning sleeve 10 from slipping downward during drilling operations.

Flexible drill string member 24 has a smaller outer diameter than self-aligning sleeve 10. Flexible drill string member 24 is connected at its upper end to retaining means 22 and at its lower end to stabilizing means 26.

Flexible drill string members 16 and 24 may include, but are not necessarily limited to, smaller diameter drill collars and regular size drill pipe. The inner diameter of self-aligning sleeve 10 may vary to accommodate the outer diameter of flexible drill string member 16. Flexible drill string member 24 must be of sufficient agility to become arcuate as weight is applied during drilling operations.

Stabilizing means 26 is connected at its upper end to the lower end of flexible drill string member 24 and at its lower end to drill bit 30. Stabilizing means 26 illustrated in FIGS. 1–3 is one generally known in the industry as a near-bit stabilizer having several blades along its exterior.

Drill bit 30 is well-known in the industry therefore its construction and operation will not be described herein.

Having described the structural elements of a drill string assembly and the self-aligning sleeve, the following is a description of the method of operating the drill string assembly with self-aligning sleeve 20 engaged.

In the oil and gas industry, instruments attached to a drill string assembly, not shown in the drawings, are used to determine the degree and direction of deviation of a borehole. Once such a determination has been made, a self-aligning sleeve 10 with a second protrusion means 20 being effect circumferentially either to the right or left of first protrusion means 18 can be chosen to correct the borehole deviation 40. FIGS. 2 and 3.

After adding a self-aligning sleeve 10 with the appropriate second protrusion means 20 the drill string assembly is lowered in borehole 40. As the self-aligning sleeve is lowered into borehole 40, self-aligning sleeve 10 rotates around flexible drill string members 16 until first protrusion means 18 is on the high side of borehole 40 and second protrusion means 20 is to the lateral side of one hole 40.

Drilling is commenced by rotating and applying weight to the drill string assembly. As flexible drill string member 16 rotates self-aligning sleeve 10 remains stationary with first protrusion means 18 communicating with the high side of borehole 40 and second protrusion means 20 communicating away from the high side, preferably with the lateral side of borehole 40. Gravitational forces on first protrusion means 18 and second protrusion means 20 allow self-aligning sleeve 10 to resist the rotation of flexible drill string member 16.

As weight is applied to the drill string assembly, flexible drill string member 24 arcuates in the direction of the low side of borehole 40, as the upper and lower ends of flexible drill string member 24 are pressed between restraining means 22 and stabilizing means 26. Blades 28 of stabilizing means 28 acts as a fulcrum, that is, it absorbs the weight and assists in the arcuation of flexible drill string member 24. As flexible drill string member 24 arcuates, stabilizing means 28 turns drill bit 30 in the correct direction.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed as the invention is:

1. A self-aligning sleeve apparatus slidable over a section of flexible drill string assembly having a rotatable drill bit for correcting the direction of a deviated borehole, comprising:

a. a non-rotating tubular sleeve slidable over that member of the flexible drill string assembly adjacent the drill bit;

b. first elliptically-shaped protrusion means attached to said sleeve for centering and stabilizing said sleeve while in the borehole;

c. second eliptically-shaped protrusion means, having a greater exterior circumference than said first protrusion means, attached to said sleeve for guiding the direction of said drill string assembly; and d. retaining means attached to the lower end of said flexible drill string member, preventing said sleeve from sliding off of said flexible drill string member.

2. The apparatus in claim 1, wherein said first protrusion means is located at the upper end of the said tubular sleeve.

3. The apparatus in claim 1, wherein said second protrusion means is placed near the lower end of said tubular sleeve.

4. The apparatus in claim 1, wherein said second protrusion means further comprises a protruded pad portion.

5. A self-aligning sleeve apparatus slideable over a flexible section of drill string assembly intermediate a drill bit and a drill string member for correcting the direction of a deviated borehole comprising:

a. a tubular, non-rotating sleeve slidable over a flexible drill string assembly adjacent the drill bit;

b. first elliptically-shaped protrusion means immovably attached to said sleeve for centering and stabilizing said sleeve in the borehole, said means substantially located at the upper end of said sleeve;

c. second elliptically-shaped protrusion means, having an exterior circumference greater than said first protrusion means, immovably attached to said sleeve for determining the direction of a drill bit on said drill string assembly, offset substantially 90° from said first protrusion means, said second protrusion means substantially located at the lower end of said sleeve; and d. retaining means connected at the lower end of said flexible drill string member, preventing said sleeve from slipping downward off of said flexible drill string member.

6. The apparatus in claim 5, wherein said second protrusion means further comprises a protruded pad portion.

7. A self-aligning sleeve apparatus slideable over a section of drill string assembly having a rotatable drill bit for correcting the direction of a deviated borehole comprising:

a. a tubular non-rotating sleeve member substantially of equal length as a flexible member of the drill string assembly and slideable over said flexible drill string member adjacent the drill bit;

b. first elliptically-shaped protrusion means attached to the upper end of said sleeve assembly for centering and stabilizing said sleeve in the borehole;

c. second elliptically-shaped protrusion means having a greater exterior circumference than said first protrusion means attached to the lower end of said sleeve member for determining the direction of the drill bit on said drill string assembly, said means further comprising a protruded pad portion; and d. retaining means connected at the lower end of said flexible drill string member, preventing said sleeve from slipping downward off of said flexible drill string member.

8. A method of correcting the direction of deviated boreholes which include the following steps:

a. providing an interconnected drill string assembly having at least a drill bit, drill stabilizing means, retaining means, and at least one flexible drill string member;

b. providing a non-rotating tubular sleeve having first elliptically-shaped protrusion means fixedly attached at its uppermost end and second elliptically-shaped protrusion means fixedly attached at its lower most end;

c. inserting said tubular sleeve over said flexible drill string member;

d. inserting said drill string assembly into said borehole with said first protrusion means aligned with the high side of said horehole and second protrusion means offset 90° from the high side of said borehole; and e. rotating and maintaining pressure on said drill string assembly whereby said lower flexible drill string member flexes toward the lower side of the borehole near said bit stabilizer to direct the drill bit in the direction desired.

9. The method in claim 8, wherein second protrusion means further comprises a protruded pad portion.

* * * * *